US006684465B1

(12) United States Patent
Jo

(10) Patent No.: US 6,684,465 B1
(45) Date of Patent: Feb. 3, 2004

(54) RATCHET CLIP

(76) Inventor: Alejandro Jo, 444 Brickell Ave., Suite 53-5720, Miami, FL (US) 33131

( * ) Notice: Subject to any disclaimer, the term of this patent is extended or adjusted under 35 U.S.C. 154(b) by 0 days.

(21) Appl. No.: 10/144,217

(22) Filed: May 11, 2002

(51) Int. Cl.[7] ..... A41F 1/00
(52) U.S. Cl. ..... 24/344; 24/506
(58) Field of Search ..... 24/506, 517, 509, 24/344, 510, 511; 81/314, 319–325, 328, 338, 340, 392, 421–424; 269/254 CS; 294/99.1, 99.2, 106

(56) References Cited

U.S. PATENT DOCUMENTS

| | | | | |
|---|---|---|---|---|
| 1,052,982 A | * | 2/1913 | Sturtevant et al. | 294/2 |
| 2,577,008 A | * | 12/1951 | Engstrom | 606/201 |
| 4,153,321 A | | 5/1979 | Pombrol | |
| 4,489,466 A | | 12/1984 | Bakker | |
| 4,621,401 A | * | 11/1986 | Anderson | 29/229 |
| 4,787,279 A | * | 11/1988 | Undin | 81/313 |
| 5,305,502 A | | 4/1994 | Abrahams | |
| 5,427,004 A | | 6/1995 | Monaco | |
| 5,568,916 A | | 10/1996 | Gibbons et al. | |
| 5,676,271 A | | 10/1997 | Reynard | |
| 5,957,010 A | | 9/1999 | Petts | |
| 6,059,245 A | | 5/2000 | Hermansen et al. | |
| 6,240,815 B1 | * | 6/2001 | Huang | 81/328 |
| 6,334,239 B1 | * | 1/2002 | Kraut | 24/3.6 |
| 6,336,386 B1 | * | 1/2002 | Lee | 81/328 |
| 2002/0083558 A1 | * | 7/2002 | Tsou | 24/3.12 |

FOREIGN PATENT DOCUMENTS

| | | | | |
|---|---|---|---|---|
| WO | WO 8505312 A | * | 12/1985 | B25B/9/00 |

* cited by examiner

*Primary Examiner*—James R. Brittain
(74) *Attorney, Agent, or Firm*—Jack Lo

(57) ABSTRACT

A ratchet clip is comprised of first and second jaws hinged together at proximal ends. A serrated member is attached to the proximal end of the first jaw. Teeth on the serrated member are angled against the opening direction of the second jaw. An intermediate portion of a ratchet lever is hinged to the second jaw. An inner portion of the lever is engaged against the teeth on the serrated member, and an outer portion is positioned through a hole in the second jaw. A spring positioned between the proximal ends of the jaws bias the distal ends of the jaws away from each other. One end of the spring is arranged to bias the outer portion of the lever outward, and the inner portion against the serrated member. When the lever is depressed, its inner portion is disengaged from the serrated member to allow the jaws to open.

3 Claims, 3 Drawing Sheets

RATCHET CLIP

BACKGROUND OF THE INVENTION

1. Field of the Invention

This invention relates generally to clips with hinged arms.

2. Prior Art

Clips are commonly used for securing two or more items together. A typical clip is comprised of two jaws hinged together at proximal ends. A spring connected between the jaws bias the distal ends of the jaws together for gripping. Prior art clips typically rely solely on spring pressure to keep the jaws clamped together. The springs have limited power because they must be weak enough for a user to open the jaws. Therefore, such clips may lose grip if the items being held are pulled with moderate force.

OBJECTS OF THE INVENTION

Accordingly, objects of the present ratchet clip are:

- to removably attach itself to a supporting device such as clothing;
- to grip an item securely between its jaws;
- to be easily opened by a user;
- to prevent being spread apart once the jaws are closed around an item;
- to be easily adjustable for gripping items of different sizes; and
- to easily release the item quickly without being detached from the supporting device.

Further objects of the present invention will become apparent from a consideration of the drawings and ensuing description.

BRIEF SUMMARY OF THE INVENTION

A ratchet clip is comprised of first and second jaws hinged together about a first axle at proximal ends. A serrated member attached to the first jaw is curved about the first axle. Teeth on the serrated member are angled toward the distal ends of the jaws. An intermediate portion of a ratchet lever is hinged about a second axle to the second jaw. An inner portion of the lever is engaged against the teeth on the serrated member, and an outer portion is positioned through a hole on the second jaw. A spring is positioned between the proximal ends of the jaws bias the distal ends of the jaws away from each other. One end of the spring is arranged to bias the outer portion of the lever outward against an edge of the hole. When the lever is pressed, it inner end is disengaged from the serrated member to allow the jaws to open. When the lever is released, its inner end is engaged against the serrated member to lock the jaws in position.

| DRAWING REFERENGE NUMERALS |
|---|
| 10. Jaw |
| 11. Jaw |
| 12. First Axle |
| 13. Proximal End |
| 14. Proximal End |
| 15. Ratchet Member |
| 16. Teeth |
| 17. Intermediate Portion |
| 18. Second Axle |
| 19. Inner Portion |
| 20. Outer Portion |
| 21. Hole |
| 22. Gripping Member |
| 23. Gripping Member |
| 24. Spring |
| 25. First End |
| 26. Second End |
| 27. Second Axle |
| 28. Spring Clip |
| 29. Ring |
| 30. Loop |

DETAILED DESCRIPTION OF THE INVENTION

Figure 1:
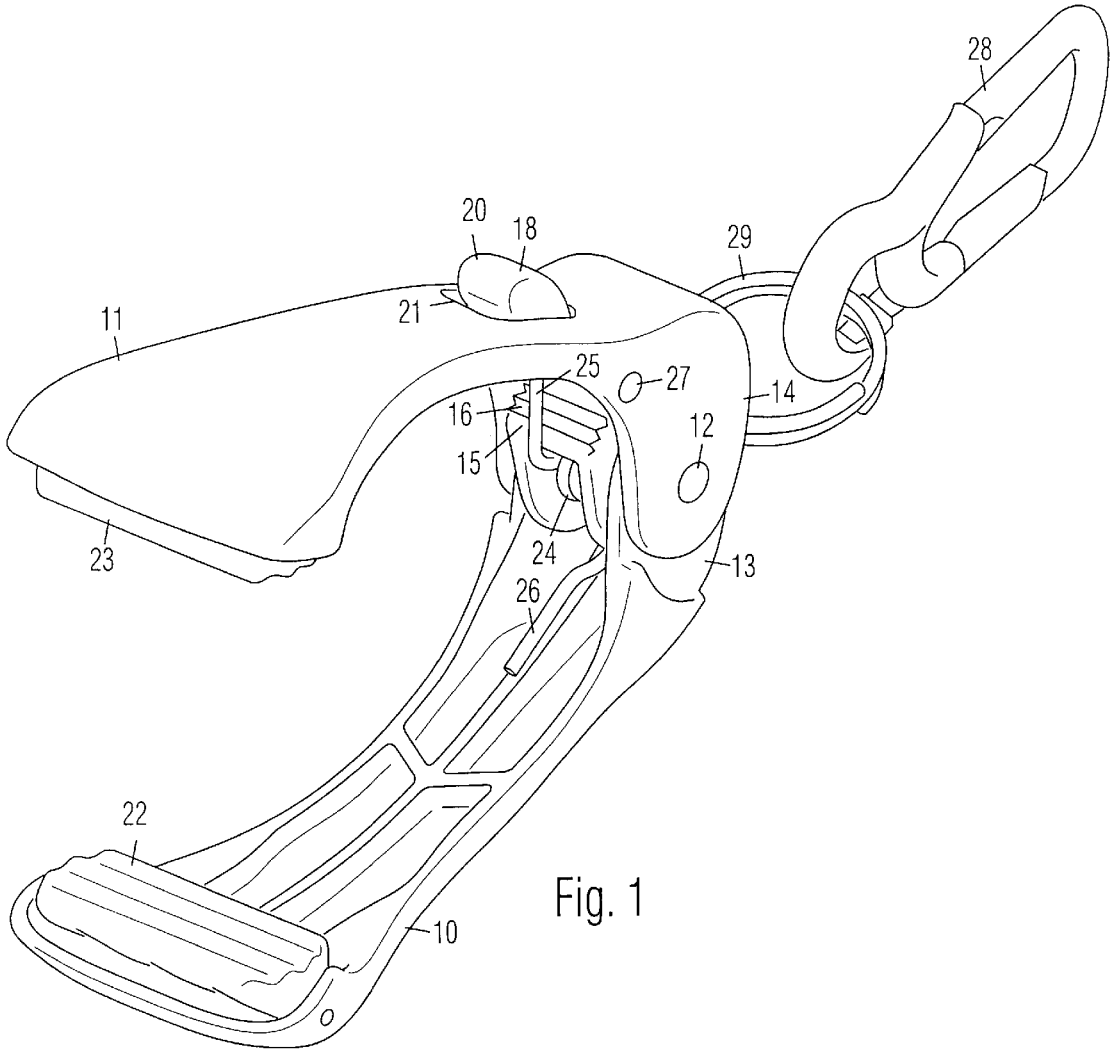
FIG. 1 is a perspective view of the present ratchet clip.

FIG. 1:

A preferred embodiment of the ratchet clip is shown in a perspective view in FIG. 1. It is comprised of first and second jaws 10 and 11 hinged together about a first axle 12 at proximal ends 13 and 14. A serrated member 15 is positioned between the proximal ends of jaws 10 and 11. Serrated member 15 is fixed to first jaw 10 and curved about first axle 12. Teeth 16 on serrated member 15 are angled against the opening direction of second jaw 11. An intermediate portion 17 (FIG. 2) of a ratchet lever 18 is hinged to second jaw 11 about a second axle 27. A serrated inner portion 19 (FIG. 2) of lever 18 is positioned between the proximal ends of jaws 10 and 11, and engaged against teeth 16 on serrated member 15. An outer portion 20 of lever 18 is positioned through a hole 21 in second jaw 11. Gripping members 22 and 23 are hinged to the distal ends of jaws 10 and 11 for providing self-adjusting gripping surfaces when jaws 10 and 11 are wide open.

A coil spring 24 is positioned between the proximal ends of jaws 10 and 11. A first end 25 of spring 24 is arranged to bias outer portion 20 of lever 18 outward and inner portion 19 of lever 18 against serrated member 15. Since lever 18 is attached to second jaw 11, second jaw 11 is also biased outward by spring 24. A second end 26 of spring 24 is arranged to bias against the inner side of first jaw 10. The distal ends of jaws 10 and 11 are thus biased away from each other.

A spring clip 28 is attached to first jaw 10 by a ring 29 connected to loop 30 (FIG. 2) attached to first jaw 10. Spring clip 28 may be hooked to any supporting device, such as clothing, backpacks, tool bags, etc. The clip is usable for gripping items between its jaws, such as gloves, to the supporting device, such as clothing. It can easily and quickly release the items without being detached from the supporting device.

Figure 2:
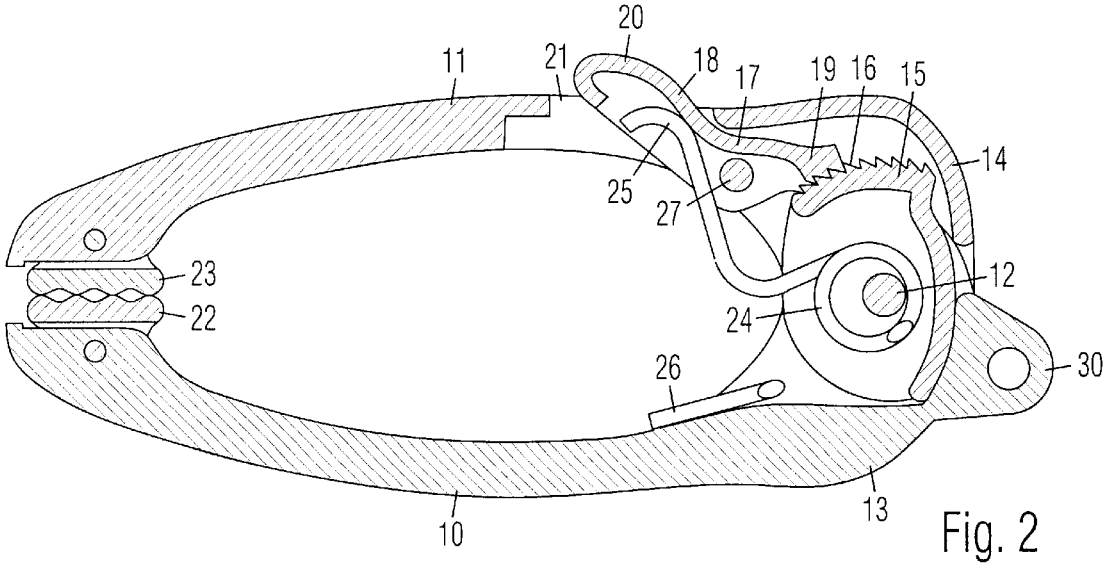
FIG. 2 is a sectional view thereof when closed.

FIGS. 2–5:

In FIG. 2, jaws 10 and 11 are fully closed. Inner portion 19 of lever 18 is engaged against serrated member 15. Teeth 16 on serrated member 15 are angled against the opening direction of second jaw 11. Inner end 19 of lever 18 cannot slide against the direction teeth 16 are angled. Therefore, inner portion 19 of lever 18 is locked against serrated member 15. Since serrated member 15 is fixed to first jaw

Figure 3:
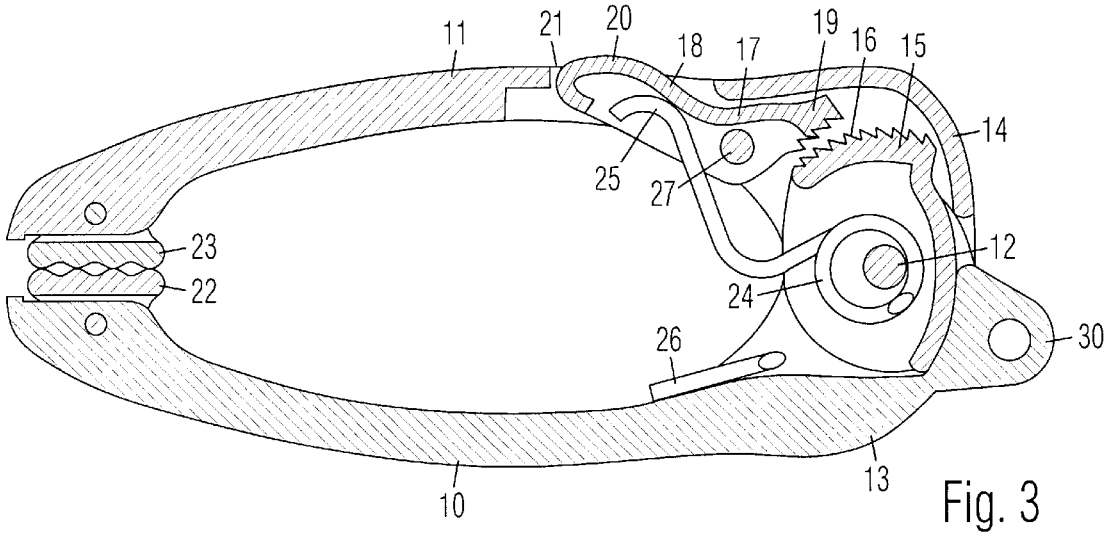
FIG. 3 is a sectional view thereof when a ratchet lever is pressed.

10, second jaw 11 is also locked relative to first jaw 10 so that they cannot be accidentally spread apart. In FIG. 3, the outer portion of lever 18 is depressed and its inner end is disengaged from serrated member 15, and jaws 10 and 11 are free to spread open under the pressure of spring 24.

Figure 4:
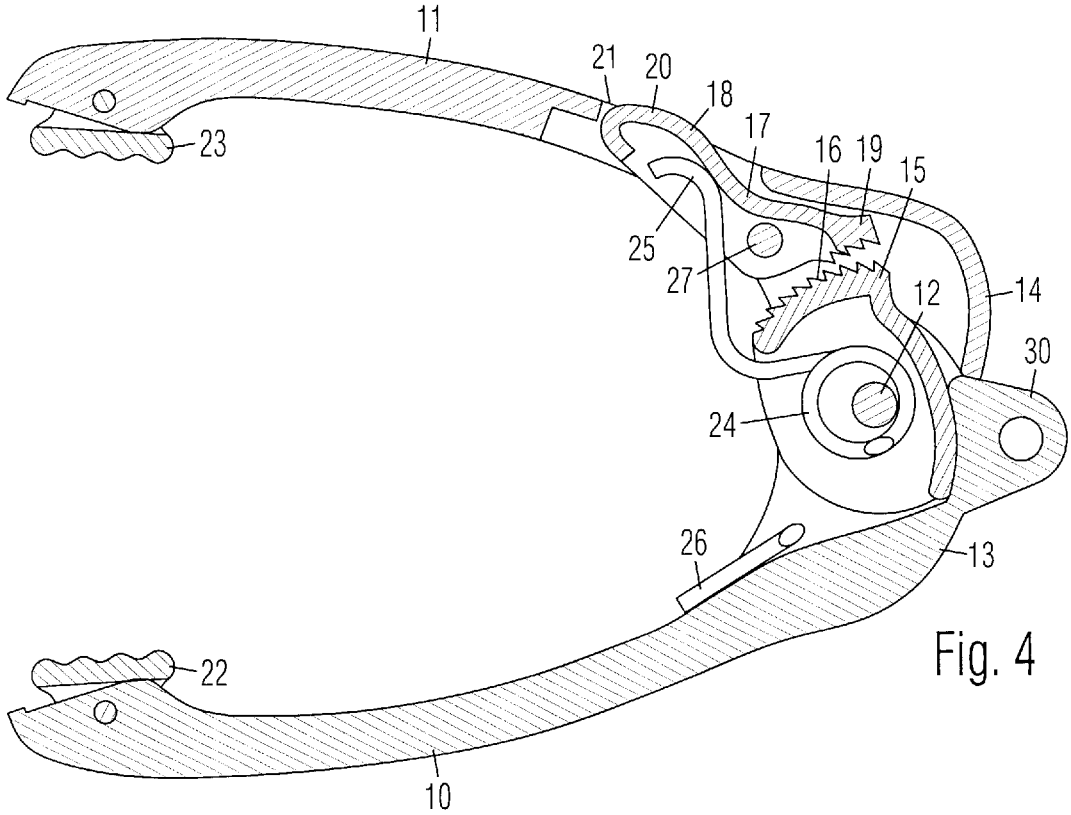
FIG. 4 is a sectional view thereof when its jaws are opened.
Figure 5:
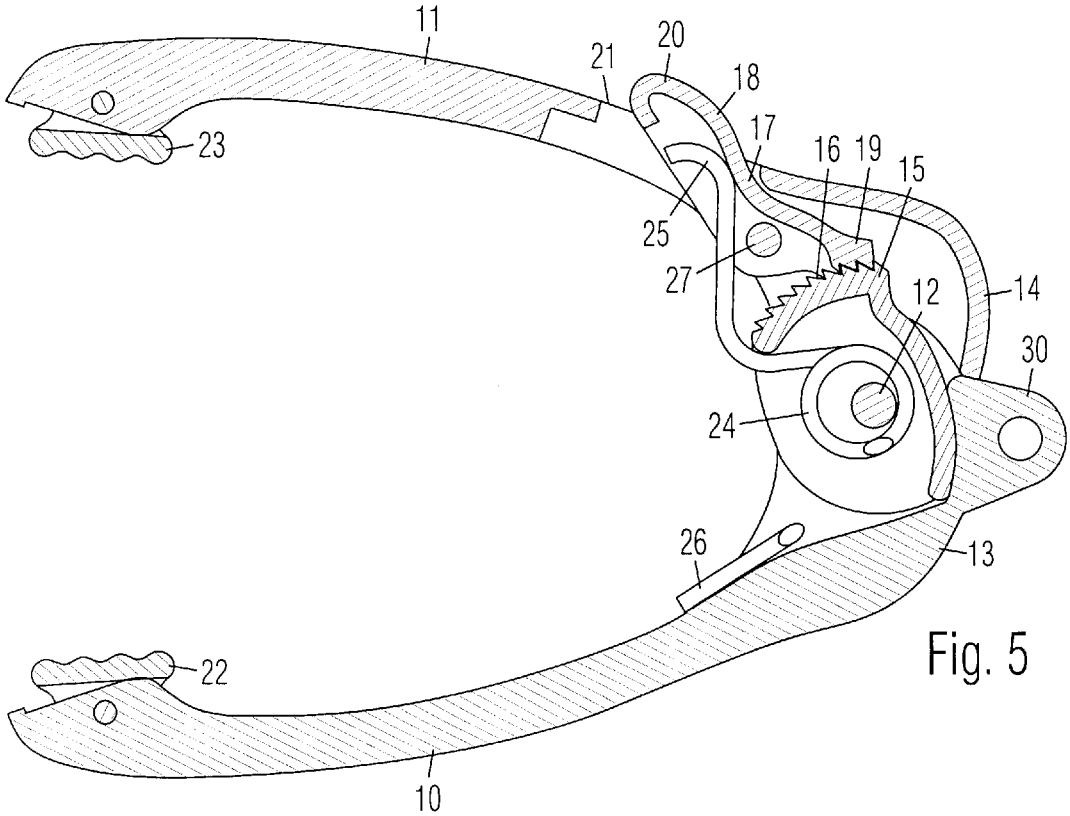
FIG. 5 is a sectional view thereof when its jaws are locked open.

In FIG. 4, jaws 10 and 11 are opened to a desired position while lever 18 is still depressed. In FIG. 5, lever 18 is released to engage its inner portion against serrated member 15 and lock jaws 10 and 11 in position. Jaws 10 and 11 may be opened to any position within a range determined by teeth 16 of serrated member 15. Jaws 10 and 11 cannot open any further when it is locked in a selected position. Jaws 10 and 11 can be tightened together by pressing them closer. Inner portion 19 of lever 18 are arranged to slide past teeth 16 to allow second jaw 11 to be pivoted towards first jaw 10. When jaws 10 and 11 are opened, gripping members 22 and 23 are free to pivot into parallel position for improving grip.

SUMMARY AND SCOPE

Accordingly, the present ratcheting clip can grip an item securely between its jaws. It is easily opened by pressing the lever. It cannot be accidentally loosened once the jaws are closed around the item. It is also easily adjustable for gripping items of different sizes.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A ratchet clip, comprising:

a first jaw and a second jaw with proximal ends hinged together by a first axle;

a serrated member positioned between said proximal ends of said first jaw and said second jaw, wherein said serrated member is fixed to said first jaw and curved about said first axle, and includes teeth angled against an opening direction of said second jaw;

a ratchet lever with an intermediate portion hinged to said second jaw by a second axle, wherein a serrated inner portion of said lever is positioned between said proximal ends of said first jaw and said second jaw, and detachably engaged against said teeth on said serrated member to prevent said first jaw and said second jaw from opening, said second axle and said inner portion of said lever are substantially hidden inside said second jaw, an outer portion of said lever is positioned through a hole in said second jaw; and a spring positioned between said proximal ends of first jaw and said second jaw, wherein a first end of said spring is arranged to bias an outer portion of said lever outward and said serrated inner portion of said lever against said serrated member, so that said second jaw is also biased outward by said spring, a second end of said spring is arranged to bias against an inner side of said first jaw, whereby said distal ends of said first jaw and said second jaw are biased away from each other;

whereby when said outer portion of said lever is depressed, said serrated inner portion of said lever is disengaged from said serrated member to allow said first jaw and said second jaw to open under pressure of said spring.

2. A ratchet clip, comprising:

a first jaw and a second jaw with proximal ends hinged together by a first axle;

a serrated member positioned between said proximal ends of said first jaw and said second jaw, wherein said serrated member is fixed to said first jaw and curved about said first axle, and includes teeth angled against an opening direction of said second jaw;

a ratchet lever with an intermediate portion hinged to said second jaw by a second axle, wherein a serrated inner portion of said lever is positioned between said proximal ends of said first jaw and said second jaw, and detachably engaged against said teeth on said serrated member to prevent said first jaw and said second jaw from opening; and a spring positioned between said proximal ends of first jaw and said second jaw, wherein said spring is coiled around said first axle and has an outwardly extended first end and an outwardly extended second end which are biased to rotate generally about said first axle, said first end of said spring is arranged to bias an outer portion of said lever outward and said serrated inner portion of said lever against said serrated member, so that said second jaw is also biased outward by said spring, said second end of said spring is arranged to bias against an inner side of said first jaw, whereby said distal ends of said first jaw and said second jaw are biased away from each other;

whereby when said outer portion of said lever is depressed, said serrated inner portion of said lever is disengaged from said serrated member to allow said first jaw and said second jaw to open under pressure of said spring;

a loop attached to said proximal end of said first jaw;

a ring connected to said loop; and a spring clip connected to said ring for attaching to a supporting device.

3. A ratchet clip, comprising:

a first jaw and a second jaw with proximal ends hinged together by a first axle;

a serrated member positioned between said proximal ends of said first jaw and said second jaw, wherein said serrated member is fixed to said first jaw and curved about said first axle, and includes teeth angled against an opening direction of said second jaw;

a ratchet lever with an intermediate portion hinged to said second jaw by a second axle, wherein a serrated inner portion of said lever is positioned between said proximal ends of said first jaw and said second jaw, and detachably engaged against said teeth on said serrated member to prevent said first jaw and said second jaw from opening;

a spring positioned between said proximal ends of first jaw and said second jaw, wherein a first end of said spring is arranged to bias an outer portion of said lever outward and said serrated inner portion of said lever against said serrated member, so that said second jaw is also biased outward by said spring, a second end of said spring is arranged to bias against an inner side of said first jaw, whereby said distal ends of said first jaw and said second jaw are biased away from each other;

whereby when said outer portion of said lever is depressed, said serrated inner portion of said lever is disengaged from said serrated member to allow said first jaw and said second jaw to open under pressure of said spring; and a first gripping member and a second gripping member respectively hinged to distal ends of said first jaw and said second jaw on the same side of said first axle as said lever.

* * * * *